US005743433A

United States Patent [19]

Hawkins et al.

[11] Patent Number: 5,743,433

[45] Date of Patent: Apr. 28, 1998

[54] COMBINATION CARBONATOR AND PLAIN WATER BOOSTER

[75] Inventors: John T. Hawkins, Adkins, Tex.; W. David Vinson, Peachtree City, Ga.; Thomas L. Guy, III; Samuel Durham, both of San Antonio, Tex.

[73] Assignee: The Coca-Cola Company, Atlanta, Ga.

[21] Appl. No.: 550,614

[22] Filed: Oct. 31, 1995

[51] Int. Cl.[6] ..... B67D 5/08

[52] U.S. Cl. ..... 222/64; 222/129.2; 222/386.5; 222/389

[58] Field of Search ..... 222/64, 95, 105, 222/129.1, 129.2, 144.5, 146.6, 386.5, 389, 395; 261/DIG. 7

[56] References Cited

U.S. PATENT DOCUMENTS 3,664,550 5/1972 Carothers et al. ..... 222/129.2

4,041,944 8/1977 Rhodes ..... 222/386.5

5,021,219 6/1991 Rudick et al. ..... 222/129.2

*Primary Examiner*—Philippe Derakshani

*Attorney, Agent, or Firm*—Donald R. Comuzzi; Christopher L. Makay

[57] ABSTRACT

A carbonator and plain water booster includes a tank and a bladder mounted within the tank that separates the tank into a carbonated water chamber and a plain water chamber. The carbonated water chamber connects to a water source and a $CO_2$ source to facilitate the forming of carbonated water, while the plain water chamber connects only to the water source. The pressure of the carbonated water and $CO_2$ gas within the carbonated water chamber expands the bladder into the plain water chamber, resulting in the pressurizing of the water within the plain water chamber. That pressurization allows the dispensing of plain water with a beverage syrup at a pressure sufficient to maintain a proper mix ratio between the plain water and the beverage syrup.

11 Claims, 2 Drawing Sheets

COMBINATION CARBONATOR AND PLAIN WATER BOOSTER

BACKGROUND OF THE INVENTION

1. Field of the Invention

The present invention relates to dispensing equipment and, more particularly, but not by way of limitation, to a combination carbonator and plain water booster.

2. Description of the Related Art

Beverage dispenser systems typically dispense a beverage syrup mixed with either plain water to form a drink or carbonated water to form a carbonated drink. A beverage dispenser includes a bin that houses a cooling device such as a refrigeration unit or a cold plate.

In the case of the refrigeration unit, the bin also houses beverage syrup cooling coils that connect at inlets to a beverage syrup source, a plain water coil that connects at an inlet to a plain water source, and a carbonator that connects at inlets to the plain water source and a $CO_2$ source. The outlets from the beverage syrup cooling coils, plain water coil, and carbonator connect to dispensing valves that mix either the carbonated water or plain water with the beverage syrup when activated.

When a cold plate forms the cooling device, the cold plate connects at inlets to a beverage syrup source, a plain water source, and carbonator. The outlets from the cold plate connect to dispensing valves that mix either the plain water or carbonated water with the beverage syrup during dispensing.

Pumps are connected between the beverage syrup source and either the beverage syrup cooling coils or the beverage syrup lines of the cold plate to pump the beverage syrup under pressure to the dispensing valves. Furthermore, the carbonator is pressurized due to the $CO_2$ source, resulting in the carbonator dispensing carbonated water under pressure which increases the flow rate of the carbonated water. The increased pressures of the carbonated water and beverage syrup ensures the carbonated drinks are dispensed quickly and at the proper beverage syrup to carbonated water ratio.

The plain water line often remains unpressurized with the only pressure resulting from the pressure within public water lines. unfortunately, that pressure is small when compared to the pressure applied by the pumps to the beverage syrup within the beverage syrup cooling coils or cold plate. Thus, when drinks requiring beverage syrup and plain water are desired, the flow rate of the beverage syrup is significantly greater than flow rate of the plain water. Consequently, the beverage syrup to plain water ratio is improper because there is too much beverage syrup and too little plain water. Such drinks typically taste poorly because they are too sweet.

To prevent improper drink ratios between the plain water and the beverage syrup, a separate plain water booster is included in the dispensing system. The booster is typically a tank including a bladder dividing the tank into first and second compartments. The first compartment connects to a water source, while the second compartment connects to a source of pressurized gas so that pressure is exerted against the water within the first compartment. Accordingly, a booster increases the dispensing flow rate of the plain water to the level required for a proper mix ratio with the beverage syrup. However, when a separate booster is utilized, the dispensing system requires an additional pump and pump motor to fill the first compartment of the tank with plain water.

Although a booster eliminates the drink mix ratio problem, it introduces new and additional equipment which increases the complexity, size, and cost of the beverage dispensing system. Operational space for establishments in the food and drink service industry is typically expensive to rent or purchase and, therefore, limited in overall size as much as possible. Consequently, dispensing systems that include expensive additional equipment thereby increasing both cost and space requirements are undesirable. Alternatively, beverage dispensing systems that have reduced space requirements are highly desirable.

SUMMARY OF THE INVENTION

In accordance with the present invention, a carbonator and plain water booster includes a tank. A bladder mounted within the tank separates the tank into a carbonated water chamber and a plain water chamber. The carbonated water chamber connects to a water source and as $CO_2$ source to facilitate the forming of carbonated water, while the plain water chamber connects only to the water source. The pressure of the carbonated water and $CO_2$ gas within the carbonated water chamber expands the bladder into the plain water chamber, resulting in the pressurizing of the water within the plain water chamber. That pressurization allows the dispensing of plain water with a beverage syrup at a pressure sufficient to maintain a proper mix ratio between the plain water and the beverage syrup.

In an alternative embodiment, a wall divides the tank into the carbonated water chamber and the plain water chamber. A bladder resides between the wall and the plain water chamber to create a gas chamber. Gas under pressure is placed in the gas chamber to expand the bladder so that the water within the plain water chamber is pressurized, thereby ensuring a proper mix ratio of beverage syrup and plain water.

It is, therefore, a object of the present invention to provide a carbonator and plain water booster within a single tank.

Still other objects, features, and advantages of the present invention will become evident to those skilled in the art in light of the following.

DETAILED DESCRIPTION OF THE PREFERRED EMBODIMENTS

Figure 1:
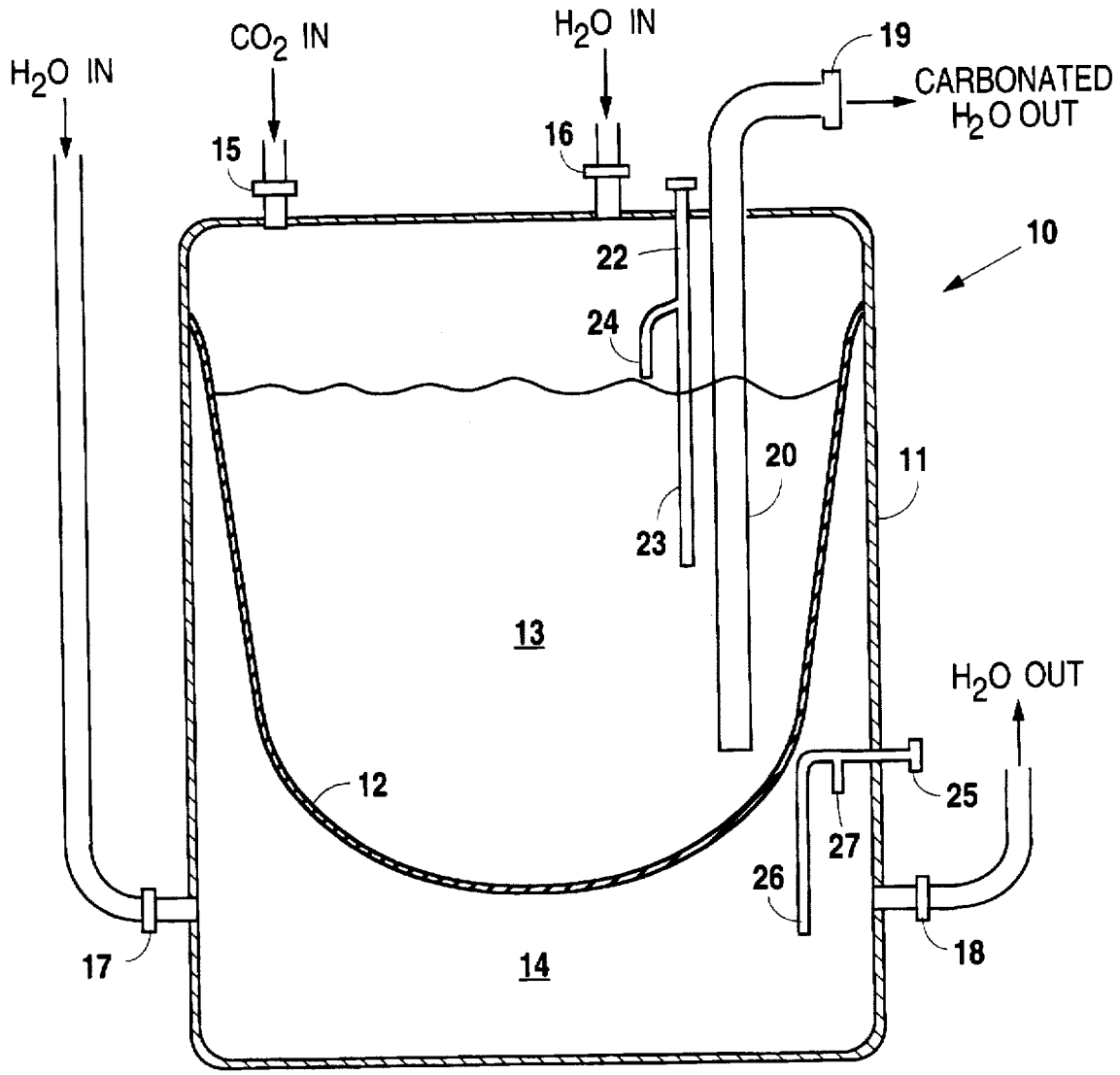
FIG. 1 is a cross-sectional view illustrating a preferred embodiment of the combination carbonator and plain water booster.

As illustrated in FIG. 1, combination carbonator and plain water booster 10 in a preferred embodiment includes tank 11. Tank 11 may be configured in any shape necessary to meet space requirements of a beverage dispensing system and, in this preferred embodiment, is constructed from any suitable material such as metal or hard plastic. Tank 11 includes bladder 12 that mounts to its interior walls using any suitable means such as a mechanical or chemical bond to divide tank 11 into chambers 13 and 14.

Carbonator and plain water booster 10 of this preferred embodiment is designed for use with any standard beverage dispensing system and, therefore, includes $CO_2$ input port 15, plain water input ports 16 and 17, plain water output port 18, and carbonated water output port 19. Each of the input and output ports includes an attachment device such as a set of threads or nozzle cap that allows connection of carbonator and plain water booster 10 within a beverage dispensing system.

Plain water inlet ports 16 and 17 connect to a water source such as a public water line via any conventional connection device such as a hose constructed of rubber, metal, or plastic. Plain water inlet ports 16 and 17 connect to the water source to inlet plain water into chambers 13 and 14, respectively. Although not shown, plain water input ports 16 and 17 each include a one-way check valve disposed therein to prevent water from returning into the public water line. More importantly, plain water input port 16 includes the one-way check valve to prevent $CO_2$ from escaping chamber 13 into the public water line.

Carbonator and plain water booster 10 includes level sensing apparatus 22 to maintain sufficient amounts of carbonated water within chamber 13. Level sensing apparatus 22 connects to a relay circuit (not shown) that controls a pump motor (not shown) which, in turn, operates a pump (not shown). Prong 23 of level sensing apparatus 22 includes a sensor (not shown) that outputs a signal when the carbonated water within chamber 13 no longer contacts it. When the sensor in prong 23 outputs a signal, the relay circuit furnishes power to the pump motor to facilitate the pumping of plain water into chamber 13 through plain water inlet port 16. Water is pumped into chamber 13 until it reaches a level where it contacts prong 24 of level sensing apparatus 22. Prong 24 contains a sensor (not shown) that outputs a signal when contacted by carbonated water. Once the sensor in prong 24 outputs a signal, the relay circuit removes power from the pump motor to stop the pumping of plain water into chamber 13.

Similarly, carbonator and plain water booster 10 includes level sensing apparatus 25 to maintain sufficient amounts of carbonated water within chamber 14. Level sensing apparatus 25 connects to the relay circuit that controls the pump motor and, thus, the pump. Prong 26 of level sensing apparatus 25 includes a sensor (not shown) that outputs a signal when the water within chamber 13 no longer contacts it. When the sensor in prong 26 outputs a signal, the relay circuit furnishes power to the pump motor to facilitate the pumping of water into chamber 14 through plain water inlet port 17. Water is pumped into chamber 14 until it reaches a level where it contacts prong 27 of level sensing apparatus 25. Prong 27 contains a sensor (not shown) that outputs a signal when contacted by water. Once the sensor in prong 27 outputs a signal, the relay circuit removes power from the pump motor to stop the pumping of water into chamber 14.

$CO_2$ inlet port 15 connects to a $CO_2$ source (not shown) using any suitable connection device such as a high pressure hose. $CO_2$ inlet port 15 connects to the $CO_2$ source to inlet $CO_2$ into chamber 13. $CO_2$ inlet port 15 also includes a one-way check valve (not shown) to prevent the escape of $CO_2$ gas from chamber 13. The $CO_2$ source includes a pressure regulator (not shown) set to a predetermined amount, typically 70 psi. Once the pressure regulator is set, the $CO_2$ source maintains the pressure of the $CO_2$ gas within chamber 13 at the predetermined pressure so that the molecules of the pressurized $CO_2$ gas above the plain water diffuse into the water and become entrained therein to carbonate the water as required for carbonated beverages.

The carbonated water and pressurized $CO_2$ gas above the carbonated water not only furnish the carbonated water for carbonated beverages, but they also pressurize the water within chamber 14 to a pressure sufficient to ensure a proper mix ratio between the plain water and beverage syrup in uncarbonated beverages. In this preferred embodiment, bladder 12 is formed a flexible rubberized material that permits its expansion into chamber 14 under the pressure developed against it by the $CO_2$ gas and carbonated water within chamber 13. The expansion of bladder 12 into chamber 14 transfers the pressure within chamber 13 to chamber 14 to pressurize the plain water within chamber 14. Consequently, the plain water dispensed from chamber 14 of carbonator and plain water booster 10 has sufficient pressure to ensure a proper mix ratio with the beverage syrup because bladder 12 exerts the pressure of the $CO_2$ gas and carbonated water within chamber 13 into chamber 14.

Plain water outlet port 18 connects to a cooling device of the beverage dispensing system (e.g., a cold plate or cooling coils within a refrigeration type unit) via a water line (not shown). Plain water outlet port 18 connects to the cooling device so that cooling of the plain water occurs before dispensing of the plain water and beverage syrup from dispensing valves of the beverage dispensing system.

Carbonated water outlet port 19 connects to the cooling device of the beverage dispensing system (e.g., a cold plate or cooling coils within a refrigeration type unit) via a carbonated water line (not shown). Carbonated water outlet port 19 connects to the cooling device to permit the cooling of the carbonated water before dispensing of the carbonated water and beverage syrup from dispensing valves of the beverage dispensing system. Additionally, $CO_2$ outlet port 19 connects to line 20 that extends into the bottom of chamber 13 to ensure a constant supply of carbonated water from carbonator and plain water booster 10.

Alternatively, if carbonator and plain water booster 10 resides in the bin housing the cooling unit of the beverage dispensing system, the plain water inlet into chambers 13 and 14 from plain water inlet ports 16 and 17, respectively, is cooled prior to inletting into chambers 13 and 14. Consequently, plain water outlet port 18 and carbonated water outlet port 19 connect directly to the dispensing valves of the beverage dispensing system. After the connection of carbonator and plain water booster 10 within a beverage dispensing system, carbonator and plain water booster 10 operates to form carbonated water and supply both carbonated water and plain water to dispensing valves of the beverage dispensing system with sufficient pressure to ensure a proper mix ratio of either with the beverage syrup.

Figure 2:
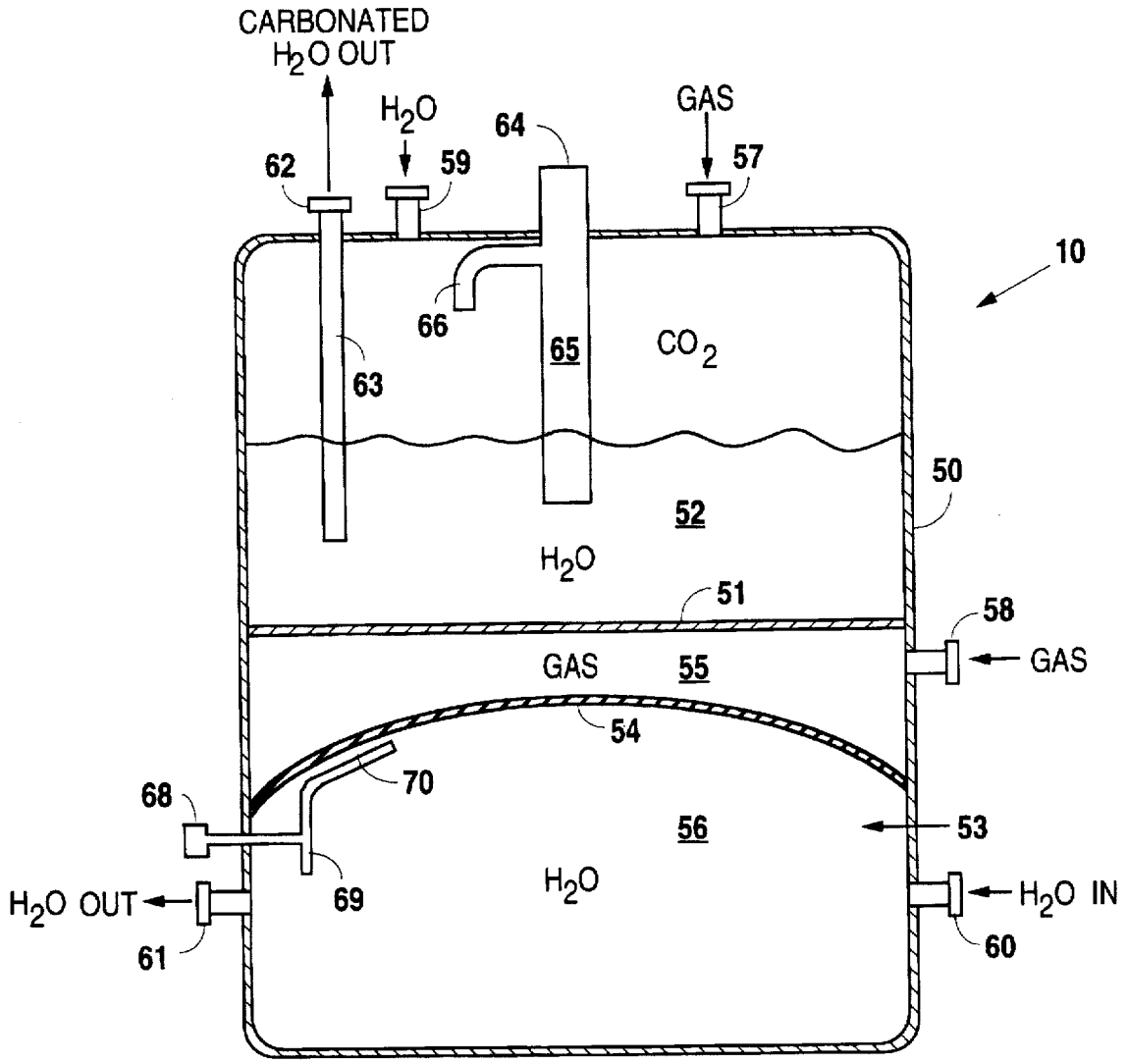
FIG. 2 is a cross-sectional view illustrating an alternative embodiment of the carbonator and plain water booster.

As illustrated in FIG. 2, combination carbonator and plain water booster 10 in an alternative embodiment includes tank 50. Tank 50 may be configured in any shape necessary to meet space requirements of a beverage dispensing system and, in this alternative embodiment, is constructed from any suitable material such as metal or hard plastic. Tank 50 includes wall 51 that mounts to its interior walls using any suitable means such as welding to divide tank 11 into chambers 52 and 53. Tank 50 further includes bladder 54 that mounts to its interior walls using any suitable means such as a mechanical or chemical bond to divide chamber 53 into chambers 55 and 56.

Carbonator and plain water booster 10 of this alternative embodiment is designed for use with any standard beverage dispensing system and, therefore, includes $CO_2$ input ports 57 and 58, plain water input ports 59 and 60, plain water output port 61, and carbonated water output port 62. Each of the input and output ports includes an attachment device such as a set of threads or nozzle cap that allows connection of carbonator and plain water booster 10 within a beverage dispensing system.

Plain water inlet ports 59 and 60 connect to a water source such as a public water line via any conventional connection device such as a hose constructed of rubber, metal, or plastic. Plain water inlet ports 59 and 60 connect to the water source to inlet plain water into chambers 52 and 56, respectively.

Although not shown, plain water input ports 59 and 60 each include a one-way check valve disposed therein to prevent water from returning into the public water line. More importantly, plain water input port 59 includes the one-way check valve to prevent $CO_2$ from escaping chamber 52 into the public water line.

Carbonator and plain water booster 10 includes level sensing apparatus 64 to maintain sufficient amounts of carbonated water within chamber 52. Level sensing apparatus 64 connects to a relay circuit (not shown) that controls a pump motor (not shown) which, in turn, operates a pump (not shown). Prong 65 of level sensing apparatus 64 includes a sensor (not shown) that outputs a signal when the carbonated water within chamber 52 no longer contacts it. When the sensor in prong 65 outputs a signal, the relay circuit furnishes power to the pump motor to facilitate the pumping of plain water into chamber 52 through plain water inlet port 59. Water is pumped into chamber 52 until it reaches a level where it contacts prong 66 of level sensing apparatus 64. Prong 66 contains a sensor (not shown) that outputs a signal when contacted by carbonated water. Once the sensor in prong 66 outputs a signal, the relay circuit removes power from the pump motor to stop the pumping of plain water into chamber 52.

Similarly, carbonator and plain water booster 10 includes level sensing apparatus 68 to maintain sufficient amounts of carbonated water within chamber 56. Level sensing apparatus 68 connects to the relay circuit that controls the pump motor and, thus, the pump. Prong 69 of level sensing apparatus 68 includes a sensor (not shown) that outputs a signal when the water within chamber 56 no longer contacts it. When the sensor in prong 26 outputs a signal, the relay circuit furnishes power to the pump motor to facilitate the pumping of water into chamber 56 through plain water inlet port 60. Water is pumped into chamber 56 until it reaches a level where it contacts prong 70 of level sensing apparatus 68. Prong 70 contains a sensor (not shown) that outputs a signal when contacted by water. Once the sensor in prong 70 outputs a signal, the relay circuit removes power from the pump motor to stop the pumping of water into chamber 56.

$CO_2$ inlet ports 57 and 58 connect to a $CO_2$ source (not shown) using any suitable connection device such as high pressure hoses. $CO_2$ inlet ports 57 and 58 connect to the $CO_2$ source to inlet $CO_2$ into chambers 52 and 55, respectively. $CO_2$ inlet ports 57 and 58 each also include a one-way check valve (not shown) to prevent the escape of $CO_2$ gas from chambers 52 and 55, respectively. The $CO_2$ source includes a pressure regulator (not shown) set to a predetermined amount, typically 70 psi. Once the pressure regulator is set, the $CO_2$ source maintains the pressure of the $CO_2$ gas within chamber 52 at the predetermined pressure so that the molecules of the pressurized $CO_2$ gas above the plain water diffuse into the water and become entrained therein to carbonate the water as required for carbonated beverages.

Similarly, the pressure regulator maintains the pressure of the $CO_2$ gas within chamber 56 at the predetermined pressure. The pressurized $CO_2$ gas within chamber 55 between wall 51 and bladder 54 pressurizes the water within chamber 56 to a pressure sufficient to ensure a proper mix ratio between the plain water and beverage syrup in uncarbonated beverages. In this alternative embodiment, bladder 54 is formed a flexible rubberized material that permits its expansion into chamber 56 under the pressure developed against it by the $CO_2$ gas within chamber 55. The expansion of bladder 54 into chamber 56 transfers the pressure within chamber 55 to chamber 56 to pressurize the plain water within chamber 56. Consequently, the plain water dispensed from chamber 56 of carbonator and plain water booster 10 has sufficient pressure to ensure a proper mix ratio with the beverage syrup because bladder 54 exerts the pressure of the $CO_2$ gas within chamber 55 into chamber 56.

Plain water outlet port 61 connects to a cooling device of the beverage dispensing system (e.g., a cold plate or cooling coils within a refrigeration type unit) via a water line (not shown). Plain water outlet port 61 connects to the cooling device so that cooling of the plain water occurs before dispensing of the plain water and beverage syrup from dispensing valves of the beverage dispensing system.

Carbonated water outlet port 62 connects to the cooling device of the beverage dispensing system (e.g., a cold plate or cooling coils within a refrigeration type unit) via a carbonated water line (not shown). Carbonated water outlet port 62 connects to the cooling device to permit the cooling of the carbonated water before dispensing of the carbonated water and beverage syrup from dispensing valves of the beverage dispensing system. Additionally, $CO_2$ outlet port 62 connects to line 63 that extends into the bottom of chamber 52 to ensure a constant supply of carbonated water from carbonator and plain water booster 10.

Alternatively, if carbonator and plain water booster 10 resides in the bin housing the cooling unit of the beverage dispensing system, the plain water inlet into chambers 52 and 56 from plain water inlet ports 59 and 60, respectively, is cooled prior to inletting into chambers 52 and 56. Consequently, plain water outlet port 61 and carbonated water outlet port 62 connect directly to the dispensing valves of the beverage dispensing system. After the connection of carbonator and plain water booster 10 within a beverage dispensing system, carbonator and plain water booster 10 operates to form carbonated water and supply both carbonated water and plain water to dispensing valves of the beverage dispensing system with sufficient pressure to ensure a proper mix ratio of either with the beverage syrup.

Although the present invention has been described in terms of the foregoing embodiments, such description has been for exemplary purposes only and, as will be apparent to one of ordinary skill in the art, many alternatives, equivalents, and variations of varying degrees will fall within the scope of the present invention. That scope, accordingly, is not to be limited in any respect by the foregoing description, rather, it is defined only by the claims that follow.

We claim:

1. A carbonator and plain water booster, comprising;

a tank, said tank, comprising:

a first plain water inlet port for inletting water into a carbonated water chamber and a $CO_2$ inlet port for inletting $CO_2$ into said carbonated water chamber to facilitate the formation of carbonated water, a carbonated water outlet port for outletting carbonated water from said carbonated water chamber a second plain water inlet port for inletting water into a plain water chamber, and a plain water outlet port for outletting pressurized plain water from said plain water chamber; and a bladder disposed within said tank for separating said tank into said carbonated water chamber and said plain water chamber and for transferring the pressure created within said carbonated water chamber by the $CO_2$ and the carbonated water to the plain water within said plain water chamber to pressurize the plain water within said plain water chamber.

2. The carbonator and plain water booster according to claim 1 wherein said tank includes means for regulating the pressure of the $CO_2$ within said carbonated water chamber.

3. The carbonator and plain water booster according to claim 1 wherein said tank includes means for regulating the level of the carbonated water within said carbonated water chamber.

4. The carbonator and plain water booster according to claim 1 wherein said tank includes means for regulating the level of the plain water within said plain water chamber.

5. A carbonator and plain water booster, comprising;

a tank; and a wall and a bladder disposed within said tank that separate said tank into a carbonated water chamber, a gas chamber, and a plain water chamber wherein said bladder transfers the pressure created within said gas chamber by $CO_2$ gas therein to the plain water within said plain water chamber to pressurize the plain water within said plain water chamber.

6. The carbonator and plain water booster according to claim 5 wherein said tank includes a first plain water inlet port for inletting water into said carbonated water chamber and a first $CO_2$ inlet port for inletting $CO_2$ into said carbonated water chamber to facilitate the formation of carbonated water.

7. The carbonator and plain water booster according to claim 6 wherein said tank includes a carbonated water outlet port for outletting carbonated water from said carbonated water chamber.

8. The carbonator and plain water booster according to claim 6 wherein said tank includes a second $CO_2$ inlet port for inletting $CO_2$ into said gas chamber.

9. The carbonator and plain water booster according to claim 8 wherein said tank includes a second plain water inlet port for inletting water into said plain water chamber.

10. The carbonator and plain water booster according to claim 5 wherein said tank includes a plain water outlet port for outletting the pressurized plain water from said plain water chamber.

11. The carbonator and plain water booster according to claim 5 wherein said tank includes means for regulating the pressure of the $CO_2$ within said gas chamber.

* * * * *